United States Patent [19]

Mizobuchi et al.

[11] Patent Number: 4,513,581

[45] Date of Patent: Apr. 30, 1985

[54] REFRIGERATOR COOLING AND FREEZING SYSTEM

[75] Inventors: Norihiro Mizobuchi; Keiji Furukawa; Takeshi Motoyama, all of Osaka, Japan

[73] Assignee: Tokyo Shibaura Denki Kabushiki Kaisha, Kawasaki, Japan

[21] Appl. No.: 573,345

[22] Filed: Jan. 24, 1984

[30] Foreign Application Priority Data

Mar. 9, 1983 [JP] Japan ..... 58-38728

[51] Int. Cl.[3] ..... F25B 41/00

[52] U.S. Cl. ..... 62/197; 62/117; 62/199

[58] Field of Search ..... 62/199, 198, 197, 525, 62/117

[56] References Cited

U.S. PATENT DOCUMENTS

| | | | |
|---|---|---|---|
| 2,047,827 | 7/1936 | Lamb | 62/117 |
| 4,227,379 | 10/1980 | Oonishi | 62/199 |
| 4,270,364 | 6/1981 | Oonishi et al. | 62/198 |
| 4,294,081 | 10/1981 | Mitani et al. | 62/140 |
| 4,322,952 | 4/1982 | Nakagawa et al. | 62/198 |

*Primary Examiner*—William E. Wayner
*Assistant Examiner*—J. Sollecito
*Attorney, Agent, or Firm*—Cushman, Darby & Cushman

[57] ABSTRACT

A refrigerator in which a refrigerator evaporator and first freezer evaporator are serially connected to a condenser and compressor. A first bypass path is defined in parallel with the refrigerator evaporator for supplying refrigerant only to the first freezer evaporator and a second bypass path including a second freezer evaporator likewise defined in parallel with the refrigerator evaporator for quickly reducing the freezer temperature. A differential pressure regulator valve is connected between the condenser and the refrigerator evaporator.

6 Claims, 6 Drawing Figures

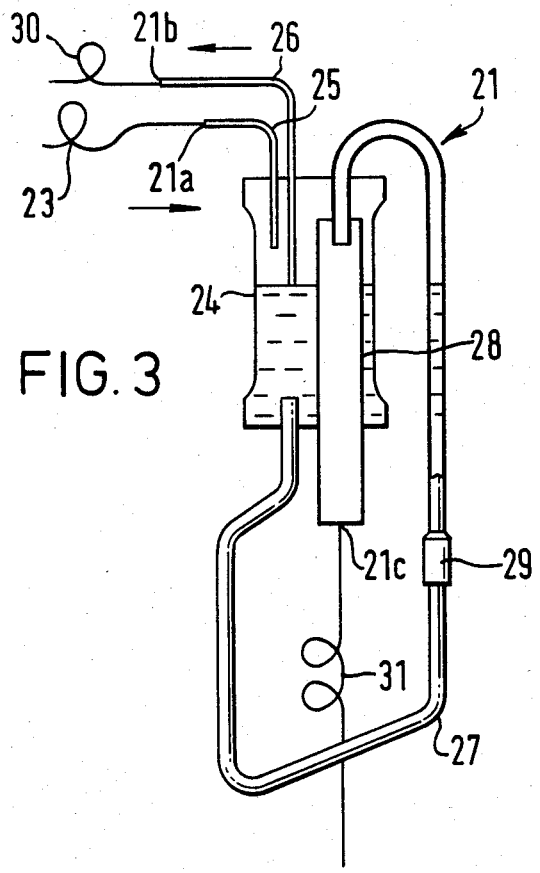
FIG. 3
FIG. 4
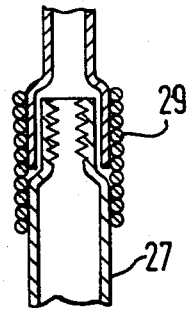

REFRIGERATOR COOLING AND FREEZING SYSTEM

BACKGROUND OF THE INVENTION

The invention relates to a refrigerator with a freezer compartment evaporator and a refrigerator compartment evaporator, the former consisting of a first evaporator and a second evaporator.

The object of this invention is to provide a refrigerator refrigeration cycle in which, in addition to adequate cooling of the freezer compartment and the refrigerator compartment, more assured and concentrated defrosting can be achieved in the freezer compartment in particular, and rapid freezing can be effected as required.

In a direct cooling type refrigerator using the inner space of a box-like cooler for a freezing chamber, U.S. Pat. Nos. 4,270,364, 4,294,081, each show a freezing refrigerator with automatic defrost. These refrigerators, however, cannot quickly freeze foods, particularly when large quantities of foods are placed in the freezer.

SUMMARY OF THE INVENTION

In the present invention a first evaporator and a second evaporator providing a low cooling temperature than the first are mounted in the freezer compartment. Refrigerant is circulated from a compressor through a condenser, capillary tube, refrigerator compartment evaporator, second freezer compartment evaporator and compressor, in that order. A first bypass path is provided in parallel with the refrigerator compartment evaporator and connected to the second freezer compartment evaporator. A second bypass path is provided, also connected to the above-mentioned second freezer compartment evaporator, but in this case via the above-mentioned first freezer compartment evaporator. A path selection device is provided for these first and second bypass paths and the abovementioned refrigerator compartment evaporator path, whereby the refrigerant can be caused to flow through the refrigerator evaporator, the first bypass path or the second bypass path.

BRIEF DESCRIPTION OF THE DRAWING

This invention will be better understood from the following description taken in connection with the accompanying drawings, in which:

FIG. 3 shows a schematic longitudinal section of the air-lift pump;

FIG. 4 shows an enlarged longitudinal section of the heater part of this pump;

DETAILED DESCRIPTION OF THE PREFERRED EMBODIMENT

Figure 1:
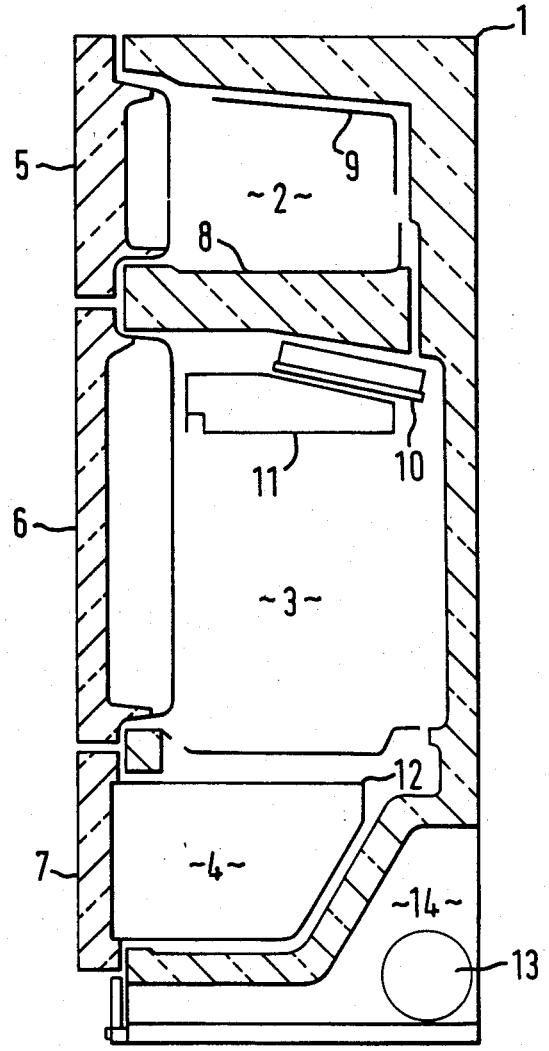
FIG. 1 is a schematic longitudinal section of the complete refrigerator cabinet.

An explanation follows of an embodiment of the invention referring to the drawings.

In FIG. 1, a cabinet 1 of a refrigerator has a freezer compartment 2 in its upper section, a refrigerator compartment 3 in its center section, and a vegetable storage compartment 4 in its lower section, these compartments having doors 5, 6 and 7 respectively. A first evaporator 8 is provided on the floor of the freezer compartment 2, and a second evaporator 9 on the roof and rear wall of the freezer compartment 2.

An evaporator 10 is provided also at the rear part of the top of the refrigerator compartment 3, and a fresh food container 11 for storing meat and fish is provided below the refrigerator compartment evaporator 10.

A vegetable container 12 is installed in the vegetable storage compartment 4 and a compressor 13 (in particular, a rotary compressor) is installed in the machinery compartment 14 of cabinet 1.

Figure 2:
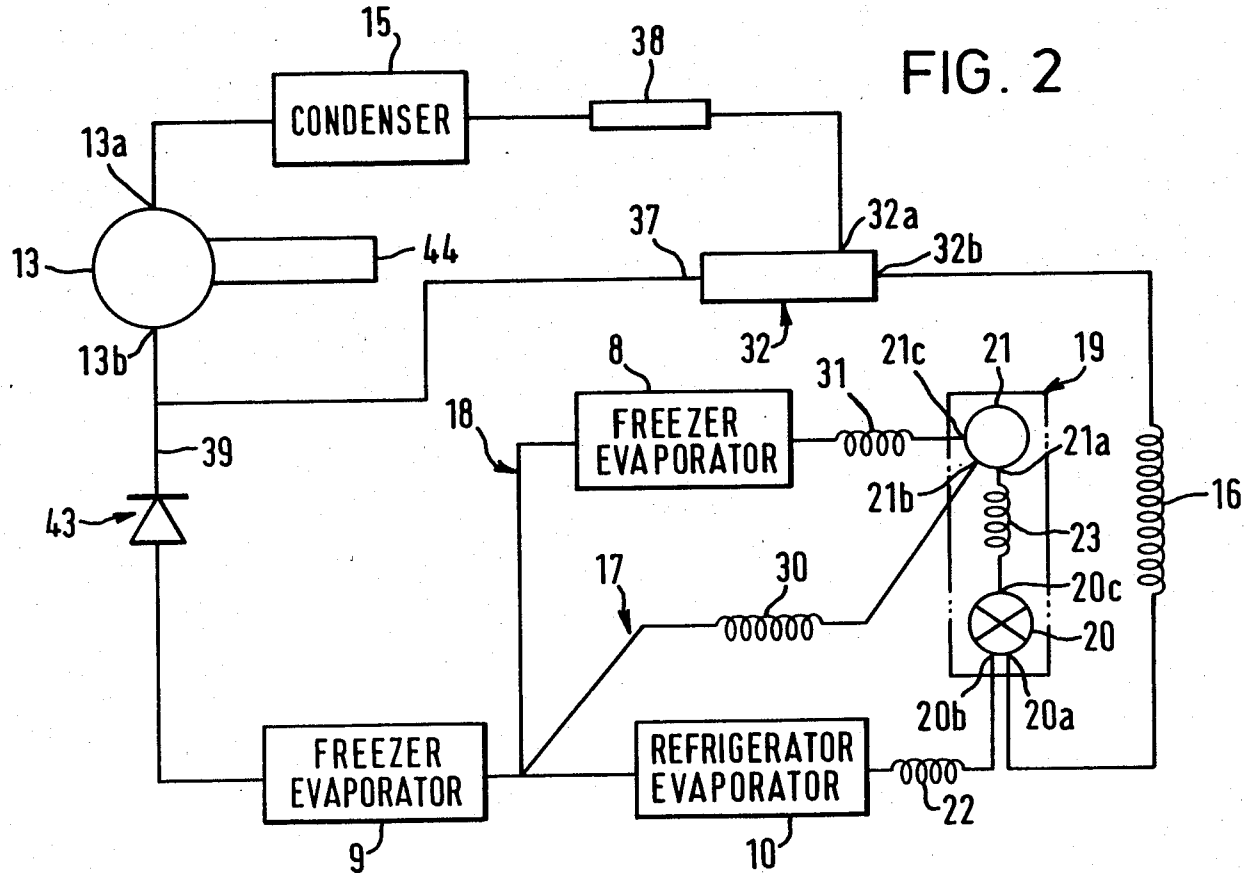
FIG. 2 shows a schematic connection diagram of the components which effeect the refrigeration cycle.

Referring to FIG. 2, the circulation system is constituted by the outlet 13*a* of the compressor 13 being connected to the inlet 13*b*, basically via a condenser 15, a capillary tube 16, the refrigerator compartment evaporator 10, and the second freezer compartment evaporator 9, in that order.

A first bypass path 17 is provided in parallel with the path including the refrigerator compartment evaporator 10 and is connected to the above-mentioned second freezer compartment evaporator 9. A second bypass path 18 is connected to the above-mentioned second evaporator 9, but in this case by way of the above-mentioned first evaporator 8. A path selection device 19 is provided for these bypass paths 17 and 18 and the above-mentioned refrigerator compartment evaporator 10 path, whereby the refrigerant can be caused to flow through any of these paths.

The path selection device 19 in this embodiment is connected to a capillary tube 16 connected to the inlet 20*a* of the solenoid valve 20. Outlet 20*b* of solenoid valve 20 remains open even when the valve is shut and is connected, via a first auxiliary capillary tube 22, to the above-mentioned refrigerator compartment evaporator 10. The other outlet 20*c* is connected, via a second auxiliary capillary tube 23, to the inlet 21*a* of the air-lift pump 21.

As shown in detail in FIG. 3, the air-lift pump 21 consists of a liquid collector 24, an inlet pipe 25 of which the inflow end is the above-mentioned inlet 21*a* and the outflow end extends into the liquid collector 24 from above, an outlet pipe 26 of which the outflow end is the outlet 26*b* and the inflow end extends into the liquid collector 24, lower than the outflow end of the above-mentioned inlet pipe 25, a transfer pipe 27 leading from the bottom of the liquid collector 24, bending upwards in a U-turn and with its out-flow end then bending again in the shape of an inverted U to enter the liquid collector 24, another outlet pipe 28, which passes through the liquid collector 24, with the outflow end of the transfer pipe 27 connecting with it, for example by opening into it inside the liquid collector 24, while its own outflow end projects outside the liquid collector 24, thus constituting the other outlet 21*a*, and a heater 29 mounted in the middle of the transfer pipe 27, in particular at a reducing joint, as shown in FIG. 4.

One outlet, 21*b*, of pump 21 is connected to the first bypass path 17, with a third auxiliary capillary tube 30 connected between it and the first bypass path 17. The other outlet 21*c* is connected to the second bypass path 18, with a fourth auxiliary capillary tube 31 inserted before the first evaporator 8.

Figure 5:
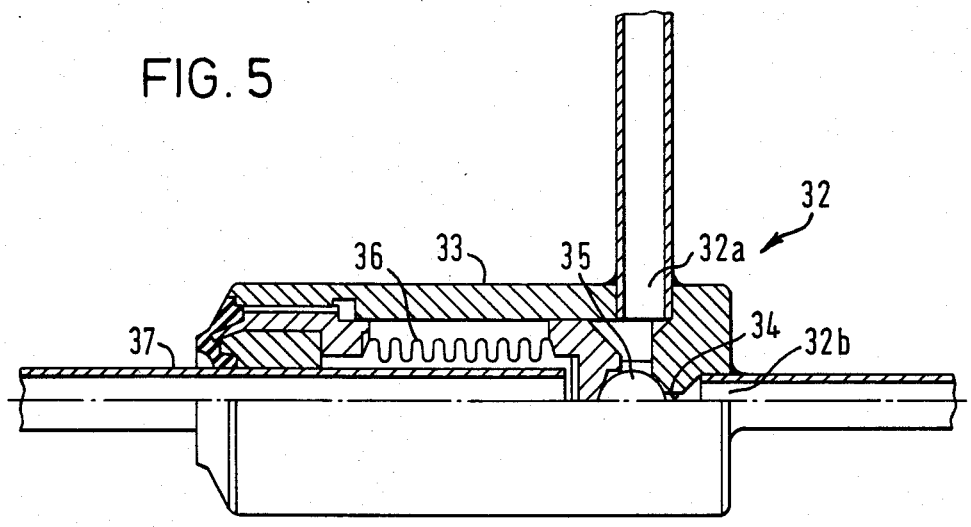
FIG. 5 shows a half longitudinal section (side view) of the differential pressure regulating valve.

FIG. 5 shows the detailed construction of the differential pressure regulating valve 32 which is connected between the condenser 15 and the capillary tube 16.

The main features of this differential pressure regulating valve 32 are a valve body 33, a valve 35, consisting of a ball which opens and closes the port 34 between the inlet 32*a* on the side of one end of the valve body 33 and the outlet 32*b* at the end of the valve body 33, a bellows 36 at the other end of the valve body 33, liquid and air-sealed which exerts a closing force on this valve 35, and a connecting pipe 37 (connecting port) extending within the bellows 36 towards the valve 35.

Figure 6:
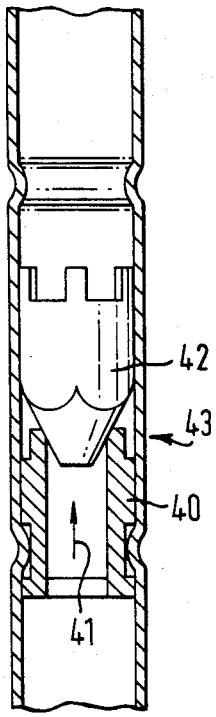
FIG. 6 shows an enlarged longitudinal section of the non-return valve.

Referring again to FIG. 2 inlet 32*a* is connected to the condenser 15 via a dryer 38. The outlet 32*b* is connected to the capillary tube 16 and the connecting pipe 37 (connecting port) is connected to a suction pipe 39, which is in the return path to the inlet 13*b* of the compressor 13. At a part of the suction pipe 39 upstream of the junction with the connecting pipe 37, a non-return valve 43 is installed. Valve 43 contains as shown in FIG. 6 a valve seat 40 and a valve plunger 42, the latter having a taper facing the normal flow of the refrigerator (indicated by the arrow 41).

In the structure described above, the resistance ratio of the third auxiliary capillary tube 30 and the fourth auxiliary capillary tube 31 is fixed at above 1:55. A thermosyphon 44 in FIG. 2 is connected to the compressor 13 for heat dissipation.

An explanation follows of the cycle. First the refrigerator which is normally inside the compressor 13 and is drawn into it through the inlet 13*b* is compressed inside the compressor 13, after which it emerges from the outlet 13*a* and proceeds to the condenser 15, where it is condensed.

This condensed refrigerant then goes by way of the dryer 38 to the differential pressure regulating valve 32.

The interior of the bellows 36 of the differential pressure regulating valve 32 is at a lower pressure, being evacuated by the compressor 13 along the connecting pipe 37. Thus, the valve 35 together with the bellows 36 is pressurized by the condensed refrigerant so that the valve port 34 is opened, and the condensed refrigerant passes, by way of capillary tube 16 and the inlet 20*a* of the solenoid valve 20 (which is shut), and then via the outlet 20*b* and the first auxiliary capillary tube 22, to the refrigerator compartment evaporator 10, where part of it evaporates, cooling the inside of the refrigerator compartment 3. The remaining refrigerant then goes to the second evaporator 9, where it evaporates, cooling the freezer compartment 2.

The evaporated refrigerant then impinges on the non-return valve 43, in particular on the valve plunger 42, in the forward direction, causing it to open, and so returns by way of the inlet 13*b* to the compressor 13, where it is compressed once again and discharged from the outlet 13*a* to the condenser 15 to repeat the process.

When as a result of this process the refrigerator compartment 3 reaches the required temperature of the refrigerator compartment, a control circuit (not shown) operates, passing current to the solenoid valve 20 and causing it to open.

Because of the relative resistances of the first auxiliary capillary tube 22 and the second auxiliary capillary tube 23, the refrigerator from capillary tube 16 enters the inlet 20*a* of the solenoid valve 20 and emerges from the second outlet 20*c*, after which it passes along the second auxiliary capillary tube 23 to enter the air-lift pump 21 by the inlet 21*a*.

The refrigerator which has entered the air-lift pump 21 by the inlet 21*a* in this way accumulates in the liquid collector 24, raising the level of the liquid until in due course it reaches the tip of the outlet pipe 26, after which it passes through the outlet pipe 26 to emerge from the outlet 21*b*, passes through the third auxiliary capillary tube 30 and then goes along the first bypass path 17, bypassing the refrigerator compartment evaporator 10.

At this stage the air-lift pump is in a non-operational state, with the heater 29 not activated. Further, partly because the resistance ratio of the third auxiliary capillary tube 30 and the fourth auxiliary capillary tube 31 is greater than 1:55, as mentioned earlier, there is no possibility of the refrigerant entering the second bypass path 18. In this case, therefore, the refrigerant cools the freezer compartment 2 by evaporating only in the second evaporator 9.

In due course, by this means, the freezer compartment 2 is also cooled to the required temperature. When this very low temperature is reached, the freezer compartment thermostat (not illustrated) which is designed to respond to the temperature in the freezer compartment, operates, cutting off the flow of current to the drive motor of the compressor 13, and thus stopping the compressor 13. When the compressor 13 is stopped refrigerator flows in the reverse direction through the compressor 13, which is a rotary compressor, but any substantial reverse flow is prevented by the non-return valve 43, which shuts as it receives the flow, the valve plunger 42 being brought into close contact with the valve seat 40.

As a result of this reverse flow, pressure inside the bellows 36 of the differential pressure regulating valve 32 increases until it equals the pressure in the valve body 33 and hence on the condenser outlet 13*a*. As this equilibrium is reached, the valve port 34 of the valve 35 is closed by the natural springiness of the bellow 36. Thus high temperature refrigerant is kept to the following path: outlet 13*a* of compressor 13—condenser 15—dryer 38—differential pressure regulating valve 32, and the inlet 13*b* of compressor 13. Refrigerant is prevented, therefore, from flowing to the refrigerator compartment evaporators 8 and 9, which prevents any abnormally high temperature in freezer compartment 2.

When, subsequently, temperatures rise in the freezer compartment 2 and the refrigerator compartment 3, the respective thermostats will revert to their unoperated state, and the mode of operation already described will restart and repeat itself.

When rapid freezing is demanded by operating the rapid freeze switch (not illustrated), the solenoid valve 20 opens as current is passed through it, and the heater 29 of the air-lift pump 21 is also energized. The liquid refrigerator, which has entered the liquid collector 24 from the inlet 20*a* of the solenoid valve via the outlet 20*c* and the second auxiliary capillary tube 23 and has accumulated in the transfer pipe 27, is heated by the heater 29 until it boils, producing bubbles. The surface of the liquid refrigerant is gradually raised as these bubbles rise through it, so that it is made to pass through the inverted U-shaped outflow end of the transfer pipe 27 and drip steadily into the outlet pipe 28.

After dripping in this way, the liquid refrigerator then flows, via the fourth auxiliary capillary tube 31, to the freezer compartment evaporator 8, i.e. to the second bypass path, and thereafter to the second evaporator 9.

Having thus flowed to the two freezer compartment evaporators 8 and 9, the liquid refrigerant evaporates in both, thus powerfully and rapidly cooling the freezer compartment 2. In this case, the second evaporator 9 is designed to produce a cooling temperature which is at least 5° C. lower than that of the first evaporator 8; and the abovementioned rapid freeze switch can be e.g. a time switch, so that when the time set has elapsed, the previous mode of operation is resumed, rapid freezing being halted and normal cooling being resumed. In this case, when the temperature of the freezer compartment 2 fails to fall to the required level because, for example, an abnormally large quantity of articles have been stored in it, an appropriate control device, e.g. a microcomputer, can detect this via the freezer compartment thermostat mentioned earlier, and, on the basis of this detection, pass current to the solenoid valve 20 and the heater 29 in the air-lift pump 21, so that a mode of operation essentially the same as the rapid freezing described above—a mode of operation guaranteeing, so to speak, the temperature of the freezer compartment—is initiated. The freezer compartment 2 is thus powerfully cooled by the refrigerator being caused to flow to the first and second freezer compartment evaporators and to evaporate in both, thus lowering the temperature rapidly to the required level.

In this case also, needless to say, once the freezer compartment 2 has reached the required temperature, operation reverts to the previous mode, with normal cooling being resumed.

In this embodiment, the refrigerator compartment 3 and the freezer compartment 2 can both be adequately cooled by circulating the refrigerant normally through the refrigerator compartment evaporator 10 and the second evaporator 9, and also by circulating it via the first bypass path 17 through the second evaporator 9 only.

In the case of rapid freezing, powerful and rapid cooling of the freezer compartment 2 can be achieved by circulating, via the second bypass path 18, through the first and second evaporators 8 and 9.

In the case also of the temperature of the freezer compartment 2 failing to fall to the required temperature, the freezer compartment 2 can be rapidly cooled likewise by circulating via the second bypass path 18 through the first and second evaporators 8 and 9.

With regard to the freezer compartment, normally the refrigerator is circulated only through the second evaporator 9, but even when, as in the case of rapid freezing and in that of "guaranteed temperature" operation, the refrigerator is circulated through both the first and second evaporators 8 and 9, concentrated and more assured freezing can be effected since the second evaporator 9 produces a lower cooling temperature than the first evaporator 8. This means that defrosting, by which the frost that has adhered is removed by means of heat generated by a defrosting heater (not illustrated, need be effected on the second evaporator 9 only, without the necessity for any defrosting of the first evaporator 8, which does away also with the need to take out the articles stored above the first evaporator 8 during defrosting.

Automatic defrosting can therefore be effected as desired, by e.g. an integrating timer operating synchronously with the action of the compressor 13.

Furthermore, the invention is not restricted to the embodiment described above and illustrated by the drawings.

In regard in particular to the concrete and detailed construction of its various parts, variations can be introduced as appropriate, provided there is no departure from the essentials of the invention.

As will be clear from the above description, this invention provides a refrigerator with a refrigeration cycle of outstanding effectiveness, whereby not merely can the refrigerator and freezer compartments be adequately cooled, but modes of operation are also possible by which the freezer compartment can be cooled rapidly and its temperature guaranteed, concentrated and more assured operation of the second freezer compartment evaporator only can be effected in each of these cases, and defrosting of the frost that has adhered can be effected without difficulty.

What is claimed is:

1. A refrigerator cooling and freezing system comprising:

a compressor;

a condenser connected to said compressor for condensing refrigerator from said compressor;

a refrigerator evaporator connected to said condenser for receiving flow of refrigerator to cool said refrigerant compartment;

a first freezer evaporator serially connected to said refrigerator evaporator and to said compressor so that refrigerator flowing therethrough is returned to said compressor;

means defining a first bypass path in parallel with said refrigerator evaporator;

a second freezer evaporator;

means defining a second bypass path in parallel with said refrigerator evaporator and said first path and directing flow through said second freezer evaporator;

selection means for controlling flow of refrigerator through said refrigerator evaporator, said first bypass path or said second bypass path;

a differential pressure regulating valve connected between said condensor and said refrigerator evaporator and non-return valve connected between said first freezer evaporator and compressor.

2. A refrigerator system as in claim 1 wherein said selection means includes a solenoid valve and an air-lift pump.

3. A system as in claim 2 wherein said selection means includes a refrigerant reservoir, a first line for supplying refrigerator to said reservoir when said valve is operated, a second line for supplying refrigerant to said first bypass path when the refrigerant in said reservoir reaches a first level, a third line connected between the bottom of said reservoir and said second bypass path and having a portion above the level of said refrigerator in said reservoir, and heating means in said second bypass path for producing bubbling of refrigerator to supply refrigerator to said second bypass path.

4. A refrigerator comprising:

a refrigerator cabinet having a freezing compartment and refrigerator compartment;

a compressor mounted in said cabinet;

a condenser mounted in said cabinet and connected to said compressor for condensing refrigerator from said compressor;

a refrigerant evaporator in said refrigerator compartment and connected to said condenser for receiving flow of refrigerator to cool and refrigerator compartment;

a first freezer evaporator serially in said freezer compartment and connected to said refrigerator evaporator and to said compressor so that refrigerant flowing therethrough is retuned to said compressor;

means defining a first bypass path in parallel with said refrigerator evaporator;

a second freezer evaporator in said freezer compartment;

means defining a second bypass path in parallel with said refrigerator evaporator and said first path and directing flow through said second freezer evaporator;

selection means for controlling flow of refrigerant through said refrigerant evaporator, and first bypass path or said second bypass path;

a differential pressure regulating valve connected between said condenser and said refrigerant evaporator and non-return valve connected between said first freezer evaporator and compressor.

5. A refrigerator as in claim 4 wherein said first evaporator is mounted on a rear wall and roof of said freezer compartment and said second evaporator is mounted on the flow of said freezer compartment.

6. A refrigerant system as in claim 1 wherein said first and second bypass path defining means each include a capillary tube.

* * * * *